United States Patent [19]

Dettelbach et al.

[11] 4,441,450

[45] Apr. 10, 1984

[54] APPARATUS FOR MELTING AND APPLYING A MELTABLE ADHESIVE

[75] Inventors: Alfred Dettelbach, Stuttgart; Roland Henzler, Nuertingen-Raidwangen, both of Fed. Rep. of Germany

[73] Assignee: Reich Spezialmaschinen GmbH, Nuertingen, Fed. Rep. of Germany

[21] Appl. No.: 353,962

[22] Filed: Mar. 2, 1982

[30] Foreign Application Priority Data

Mar. 12, 1981 [DE] Fed. Rep. of Germany ..... 3109369

[51] Int. Cl.[3] ..... B05C 5/02

[52] U.S. Cl. ..... 118/681; 118/682; 118/707; 118/411

[58] Field of Search ..... 118/681, 707, 694, 25, 118/308, 712, 17, 411, 682, 202, 410; 222/504, 146 HE, 334; 251/89.5, 149.5; 141/258, 259, 260, 261, 262

[56] References Cited

U.S. PATENT DOCUMENTS

| | | | |
|---|---|---|---|
| 2,388,805 | 11/1945 | Stahl | 222/409 X |
| 3,177,846 | 4/1965 | Archer et al. | 118/315 X |
| 3,817,206 | 6/1974 | Case | 118/17 X |
| 3,907,170 | 9/1975 | Schedrin et al. | 118/308 X |
| 4,178,876 | 6/1978 | Nicklas et al. | 118/681 |
| 4,232,064 | 6/1978 | Nicklas et al. | 118/681 X |

*Primary Examiner*—John P. McIntosh

*Attorney, Agent, or Firm*—W. G. Fasse; D. H. Kane, Jr.

[57] ABSTRACT

An apparatus for melting and applying meltable adhesive, especially in combination with edge gluing machines for continuously advancing work pieces, includes a melting chamber (4) for the meltable granular adhesive material. The melting chamber is equipped with a heatable melting insert (5). A supply container (17) for the solid meltable granular adhesive material (18) is arranged to open into the melting chamber (4). A power driven closure slide (13) is arranged between the melting chamber (4) and the supply container (17) for the granular adhesive material. The closure slide (13) is operated in such a manner that filling the melting chamber (4) with granular adhesive material (18) is free of trouble and the adhesive material may be properly processed without any difficulties, especially without any jamming.

11 Claims, 3 Drawing Figures

17
11'
26
26
24
19
19'
22
23
20
25
21
11
II
18
17
28
3
29
11'
27
14
11
13
16
12
15
5'
4
2
5
11
1
6

9
10
8
7
II

APPARATUS FOR MELTING AND APPLYING A MELTABLE ADHESIVE

CLAIM TO PRIORITY

The present application is based on the corresponding German Ser. No. 31 09 369.8, filed in the Federal Republic of Germany on Mar. 12, 1981. The priority of the German filing date is claimed for the present application.

BACKGROUND OF THE INVENTION

The present invention relates to an apparatus for melting and applying a meltable adhesive. Such an apparatus is particularly useful in combination with edge gluing machines in which the gluing operation takes place by continuously feeding the work pieces through the edge gluing machine. U.S. Pat. Nos. 4,178,876 and 4,232,064 (both issued to W. Nicklas et al) are based on German Patent Publication 2,731,799 and disclose prior art structures for the melting and applying of a meltable adhesive. In the prior art the meltable adhesive is used in the form of cylindrical cartridges which are introduced into a melting chamber in which they are pressed against a melting wall by means of a feed advance piston. Such devices are customarily equipped with an adhesive application device to which the molten adhesive is supplied for application to the narrow edge of a work piece.

The meltable adhesive cartridges or units are supplied by a magazine through a supply opening in the melting chamber, whereby a closure slide which is connected with the feed advance piston, closes the magazine during the feed advance stroke of the feed advance piston.

Meltable adhesives in this context are considered to include all synthetic material adhesives which are solid at room temperature and which are heated to liquify the adhesive for its application to the work piece. Further, these adhesives solidify substantially instantly when the work pieces are joined.

Such adhesives are originally commercially sold as a granular material. It is therefore desirable to employ the granular material directly in a melting and applying apparatus of the type described above. This would avoid the formation of cartridges of the granular material. However, difficulties have been encountered in such an endeavor because the granular material would be pressed back into the supply container as a result of the feed advance stroke, whereby the feed advance piston in the melting chamber could be jammed.

OBJECTS OF THE INVENTION

In view of the above it is the aim of the invention to achieve the following objects singly or in combination:

to construct a melting and applying apparatus of the type described above which is capable to directly handle the meltable adhesive in the form of a granular material without any trouble while simultaneously assuring the filling of the melting chamber with the granular material without any problem;

to properly open and close the supply container of the granular meltable adhesive material so that the supply of the granular adhesive material will not interfere with the main function of the melting chamber and of the feed advance piston;

to rapidly exchange one supply container for another supply container;

to make sure that the feed advance stroke of the piston in the melting chamber starts only after the melting chamber has been filled with the meltable granular adhesive material and after the supply container has been properly closed off from the melting chamber;

to positively and safely separate the granular material in the supply container from the granular material in the melting chamber; and to assure a rapid exchange of one type of meltable adhesive against another type of meltable adhesive.

SUMMARY OF THE INVENTION

The invention provides an apparatus for melting and applying a meltable adhesive to a work piece. The apparatus includes a melting chamber with a heatable adhesive melting wall provided with adhesive discharge openings and a power driven feed advance piston which is slidably supported in the melting chamber for discharging melted adhesive through the discharge openings in response to movement of a work piece past the applying portion of the apparatus. An adhesive inlet port in the melting chamber is operatively connected to an adhesive supply container which holds the granular meltable adhesive material. The supply container has an outlet connected to the inlet port of the melting chamber. A closure slide is operatively arranged for closing or opening the inlet port. A separate power drive is operatively connected to the closure slide for power operating the closure slide for supplying meltable adhesive into the melting chamber and for closing off the melting chamber from the supply container. The separate power drive is independently operable of the feed advance piston. However, end switches may be provided which are actuated by the movements of the feed advance piston for indirectly controlling the movements of the closure slide.

According to the invention the separate power drive for the closure slide is independent of the feed advance piston for the adhesive. This feature of the invention has the advantage that the inlet port of the melting chamber is safely closed off from the supply container when the filling operation is completed. Accordingly, the granular meltable adhesive material may be pressed by the feed advance piston without any jamming in the direction toward the melting wall of the melting chamber. The end sensing switches or trip dogs which indirectly control the power drive means for the closure slide in response to the movement of the feed advance piston make sure that the feed advance stroke starts only when the melting chamber has been filled with the granular material and when the closure slide has properly closed the inlet port of the melting chamber.

It is advantageous to provide the closure slide as well as the opposite wall portion of the inlet port of the melting chamber with knife edges which cooperate with each other for making sure to positively separate the meltable granular material in the supply container from the adhesive material in the melting chamber.

The meltable adhesive supply container is removably locked to the inlet port of the melting chamber, whereby the outlet opening of the supply container is closable, for example, by a manually operated gate slide. This gate slide is provided separately and independently of the power operated closure slide according to the invention in the inlet port of the melting chamber.

The supply container which is attachable to the melting chamber may be fixed in its position by locking means which cooperate simultaneously with an interrupter switch in such a manner that the power drive means for actuating the closure slide can be operated only when the supply container is properly locked to the inlet port of the melting chamber.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figures 1, 2:
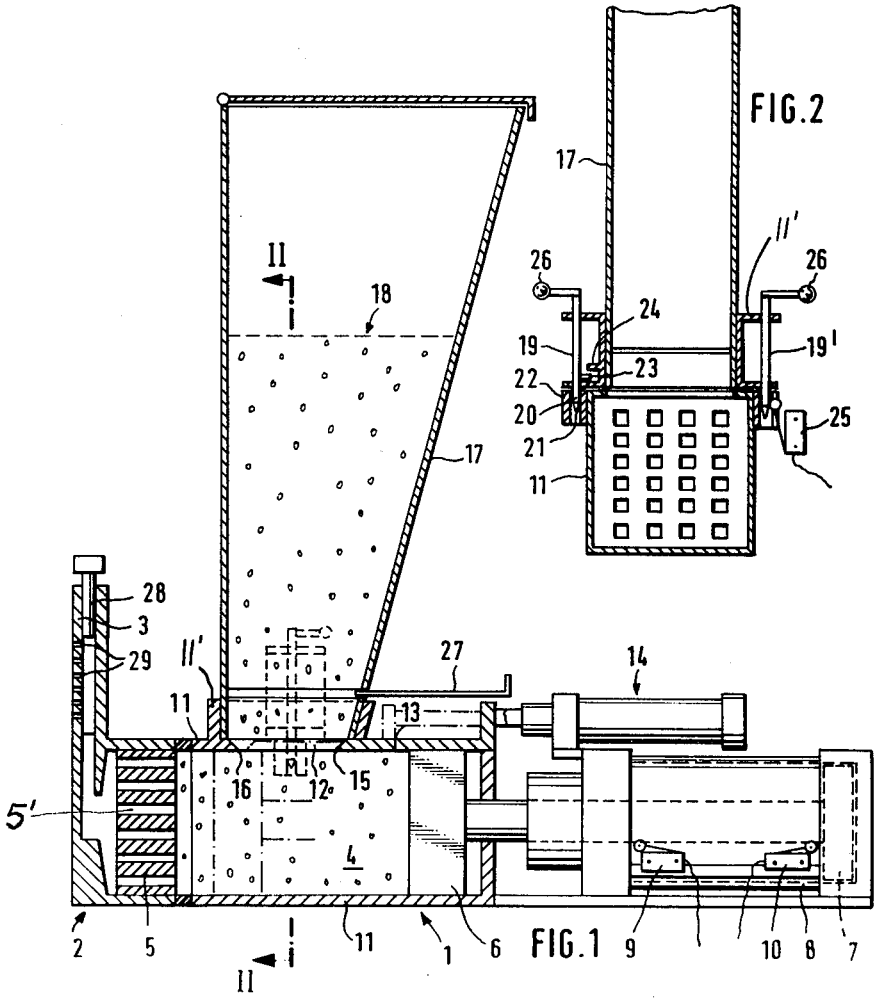
FIG. 1 shows a sectional side view of an apparatus according to the invention.
FIG. 2 shows a sectional view along section line II—II in FIG. 1.

As shown in FIG. 1 a melting device 1 is connected or integrated with an adhesive application device 2. The application device 2 comprises in this example a nozzle body 3 provided with adhesive discharge nozzles or openings 29. If desired, the nozzle body 3 may be replaced by an application roller for the adhesive. The melting device 1 comprises a melting chamber 4 which is closed at its end facing the application device 2 by a heatable melting insert or wall 5 provided with discharge openings 5' for the molten adhesive for supplying the molten adhesive into the application device 2. A first power driven feed advance means includes a drive piston 6 slidably supported in the melting chamber 4 and connected through a piston rod with a drive piston 7 in an air pressurized cylinder 8 for pushing granular adhesive material through the chamber 4. First and second trip dogs or limit switches 9 and 10 are arranged outside of the air pressure cylinder 8 for actuation in a conventional manner, for example by inductive sensor means not shown for sensing the respective return positions of the stroke ends of the piston 7.

The melting chamber 4 may be made of tubular stock 11 having a square cross-section as best seen in FIG. 2. The upwardly facing portion of the chamber forms a port wall 11 which is provided with an inlet port 12 and which is closable by a closure slide 13 slidably supported in the upper port wall 11 of the chamber 4. According to the invention the closure slide 13 is operatively connected to a second separate power driven piston drive means 14, for example a pressurized piston cylinder arrangement for sliding the closure slide 13 across the inlet port 12. The free end of the slide 13 facing the port 12 is provided with a knife edge 15 which cooperates with a further knife edge 16 in the upper port wall 11 of the chamber wall 4 opposite the slide 13 for positively closing the inlet port 12.

A supply container or hopper 17 holding a quantity of meltable granular adhesive material 18 is removably secured with its lower end portion having a discharge opening to the upper wall of the chamber 4 which is provided for this purpose with a receiving collar 11'. The container 17 opens upwardly in a conical manner and holds the granular adhesive material 18 as mentioned.

As best seen in FIG. 2 the lower end of the supply container 17 is provided on both sides with locking bars 19, 19' each having a centering pin 20 fitting or reaching into bores 21 in eyelets 22 secured to the port wall 11 of the chamber 4. At least one locking bar 19 is provided with a locking stud or pin 23 extending laterally into cooperation with a lashing boss 24 secured to the collar 11' for holding the container 17 in place when the bars 19, 19' are moved into the locking position by means of hand levers 26.

In the locked position the locking bar 19' actuates an interrupting switch 25 which cooperates with a further switch of the second power driven piston drive means 14 for the closure slide 13 in such a manner that the closure slide 13 is moved only if the locking bar 19 or 19' has actuated the interrupter switch 25. The tilting of the locking pin 23 into cooperation with the boss 24 as well as the actuation of the interrupter switch 25 is accomplished by the tilting or rotating of the locking bars 19, 19' with the aid of the hand levers 26 as mentioned.

The supply container 17 is provided at its lower end with a slide gate 27 which is manually operable to close the outlet opening at the lower end of the container 17 when the container is to be removed from the melting device 1. This is necessary if, for example, granular meltable adhesive material 18 is still present in the supply container 17.

The melting and applying apparatus according to the invention operates as follows. First the supply container 17 with its slide gate 27 in the closed position and holding meltable granular adhesive material 18 is placed with its lower end onto the collar 11' of the chamber 4. By tilting or turning the locking bars 19, 19' with the aid of the levers 26 the container 17 is locked to the chamber 4 and simultaneously the interrupter switch 25 is actuated. Thereafter, a starting switch, not shown, is actuated to bring the closure slide 13 and the first power driven feed advance piston into the full line position shown in FIG. 1 and FIG. 3. In this position the inlet port 12 is opened and upon withdrawal of the slide gate 27 the granular material 18 falls by gravity into the chamber 4 to fill the latter.

Figure 3:
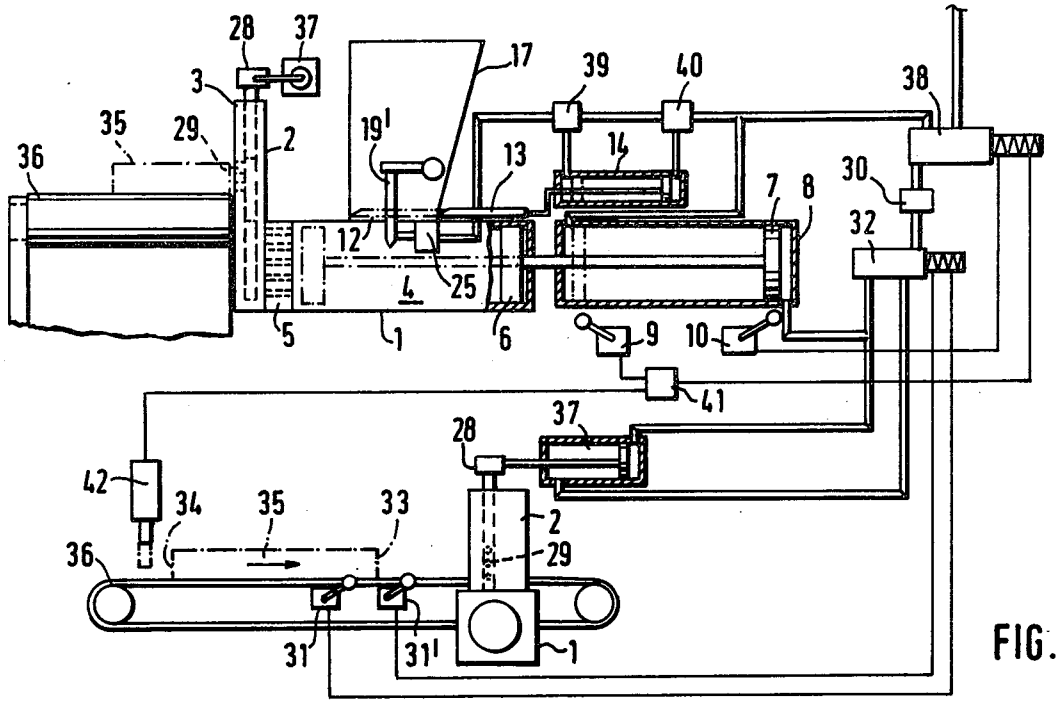
FIG. 3 is a hydraulic and electric circuit diagram for operating the apparatus of FIG. 1.

Thereafter, the starting switch is moved into an operating position, whereby the second power driven piston drive means 14 moves the closure slide 13 from the full line position in FIG. 1 and FIG. 3 into the dash-dotted line position, thereby simultaneously closing the inlet port 12 and the lower end of the supply container 17 thereby separating the melting chamber from the supply container. The operating circuit comprises a delay element 30 which causes a pressure application through the valve 32 to the piston 7 which is a resting pressure smaller than the feed advance pressure, so that the piston 6 compresses the granular meltable adhesive material in the chamber 4 in a direction toward the heated melting insert or wall 5. Thus, the portion of the granular adhesive material immediately adjacent to the heated wall 5 is being melted, whereby the maintaining of the resting pressure is intended to prevent the granular material, which is relatively elastic and not compacted, from pushing the piston too far to the rear.

The further operation of the melting and applying apparatus corresponds substantially to that described in the above mentioned U.S. Patents, whereby the first feed advance piston 6 is controlled by valve 32 in response to sensor switches 31, 31' which are actuated by the leading edge 33 and trailing edge 34 of a work piece 35 passing along a conveyor device 36 of an edge gluing machine. The control is such that the piston 7 is subjected to a higher pressure when molten adhesive is to be pressed through the discharge openings 5'. Simultaneously, an air pressurized piston cylinder arrangement 37 rotates the rotary slide valve 28 in such a manner that the nozzle openings 29 are exposed to the molten glue in the passage of the applying device 2. Thus, the molten adhesive passes through the nozzle openings 29 and onto the lateral narrow edge surfaces of a work piece 35.

If the first feed advance piston 6 reaches the end of its feed advance stroke shown by dash-dotted lines in FIG. 1 and FIG. 3, then the first end position trip dog or limit switch 9 is influenced by the piston 7 inductively so that the feed advance piston 6 is returned into the full line position through an air pressure valve 38, whereby the chamber is again ready to receive a new supply of granular adhesive material 18. The second power driven piston drive means 14 for the closure slide 13 is also actuated through a delay device 39 in such a manner that the closure slide 13 opens the inlet port 12 for the renewed filling of the melting chamber 4 with granular material out of the supply container 17.

A still further time delay element 40 makes sure that after a certain adjustable time delay the inlet port 12 is closed again by moving the closure slide 13 to the left, whereupon the piston 7 is again exposed to the lower resting pressure.

If at the time when the feed advance piston 6 reaches the dash-dotted position in FIG. 1 a work piece 35 is in front of the nozzle openings 29, then the reverse movement of the feed advance piston 6 and also of the closure slide 13 would be delayed until the work piece has completely passed the nozzle openings 29.

During the filling of the melting chamber 4 with meltable adhesive granular materials 18 it is possible to accomplish the reversing control of the feed advance system and of the closure slide 13 by means of a second end position sensing switch 10 rather than with a delay element as described. The second end position switch 10 would also be actuated by the piston 7 when the latter operates the switch 10, for example inductively when the piston 7 is in its rearmost filling position.

It is desirable to provide a further safety feature which prevents the supply of further work pieces 35 when no further granular material is present in the supply container 17 and hence not in the melting chamber 4. For this purpose the first end position sensor or limit switch 9 is connected to a time relay 49 for monitoring the motion of the piston 7 and of the closure slide 13. If granular material is not present in the melting chamber 4, the piston 7, upon reaching its rightmost filling position, immediately moves to the left again under the above mentioned resting pressure thereby to actuate the end position switch 9. In such a situation the mentioned time relay 49 controls a locking member 42 located at the input end of the conveyor device 36 for edge gluing machine 36 whereby the locking member 42 is moved into a locking position shown in dashed lines in FIG. 3 in such a manner that no further work pieces 35 may be passed through the gluing station in front of the nozzle openings 29. This situation is then only released by releasing the mentioned locking member 42 after the supply container 17 and hence the chamber 4 have been refilled with granular meltable adhesive material.

As mentioned above, it is also possible to replace the nozzle body 3 with its nozzle openings 29 by a conveyor device 36 by an adhesive application roller for applying the liquid or molten adhesive to the slide surface of a work piece. In both instances the liquid or molten adhesive is supplied to the applying device 2 from the melting device 1 as described.

Although the invention has been described with reference to specific example embodiments, it will be appreciated, that it is intended, to cover all modifications and equivalents within the scope of the appended claims.

The above described displacement units, valves and switches are schematically shown in FIG. 3. The illustration of the melting and applicating apparatus corresponds to FIG. 1. Additionally, there is included in FIG. 3 for a better understanding a schematic rear view of the edge gluing machine 36 with the melting device 1 and the application device 2. The work piece 35 is moved past the nozzle openings 29 by the conveyor devices 36 of an edge gluing machine. The work piece 35 has a leading edge 33 and a trailing edge 34. Sensor switches 31 and 31' are arranged near the conveyor device. These sensor switches are actuatable by the leading edge 33 and the trailing edge 34. The rotary slide valve 28 of the application device 2 is tiltable by means of a piston 37 operable by pressurized air. A locking member 42 is arranged at the input end of the conveyor device 36. The locking member 42 prevents in its locking position the feeding in of work pieces 35 on the conveyor device 36.

The feed advance piston 6 is actuatable by the piston 7 under pressurized air through the magnetic valve 32 which is controllable by both sensor switches 31 and 31'. Thus, it is assured, as described, that the pressure on the feed advance piston 6 is increased during the application of the meltable adhesive.

What is claimed is:

1. An apparatus for melting and applying a meltable granular adhesive to a work piece, comprising melting chamber means (4) including a heatable adhesive melting wall (5) provided with adhesive discharge openings (5'), first power driven feed advance piston drive means (6) slidably supported in said melting chamber means (4) for discharging melted adhesive through said openings (5') in response to movement of a work piece, an adhesive inlet port (12) in a port wall of said melting chamber means (4), adhesive supply container means (17) having an outlet operatively connectable to said inlet port (12), closure slide means (13) operatively arranged for sliding relative to said port wall for simultaneously closing or opening said inlet port (12) and said outlet of said supply container means, and second separate power driven piston drive means (14) operatively connected to said closure slide means (13) for power operating said closure slide means for supplying meltable adhesive into said melting chamber means (4) and for closing off the melting chamber means (4) from the supply container means (17), and control means operatively connected to said first and second driven piston drive means (6 and 14) for operating said slide means (13) separately of and prior to operation of said first feed advance piston drive means (6) so that said closing of the opening (12) and of the outlet of the supply container (17) is completed before the feed advance piston means (6) begins to move in a feed advance direction, said control means comprising limit switch means (9) operatively arranged for actuation by said power driven feed advance piston drive means (6), said limit switch means (9) controlling said second separate piston drive means (14) for the opening movement of said closure slide means (13).

2. The apparatus of claim 1, wherein said control means comprise further limit switch means (10) also operatively arranged for actuation by said feed advance piston drive means (6), said further limit switch means

(10) controlling the closing movement of said closure slide means (13).

3. The apparatus of claim 1, further comprising pressure supply means operatively connected to said first feed advance piston drive means (6) for applying an increased work pressure to said first feed advance piston drive means (6) when the latter is discharging melted adhesive and for applying a lower resting pressure to said first feed advance piston drive means (6) when melted adhesive is not being discharged but present in said chamber means (4).

4. The apparatus of claim 1, wherein said closure slide means (13) comprises a knife edge (15) at its end facing said inlet port (12).

5. The apparatus of claim 4, wherein said inlet port (12) comprises a further knife edge (16) located opposite said knife edge (15) of the closure slide means (13), whereby said knife edges cooperate with each other when the closure slide means (13) is in the closed position.

6. The apparatus of claim 1, further comprising means (19 to 24) for removably securing said adhesive supply container means (17) to said melting chamber means (4).

7. The apparatus of claim 6, further comprising slide gate means (27) arranged for closing said outlet of said adhesive supply container means (17).

8. The apparatus of claim 6 or 7, wherein said means for removably securing said adhesive supply container means (17) comprise locking bar means (19,19') and interrupter switch means (25) arranged for cooperation with said locking bar means in such a manner that said second power driven piston drive means (14) for said closure slide means (13) are disabled when said locking bar means (19, 19') are in an unlocked position for the removal of said supply container means, whereby said closure slide means (13) are kept closed when said supply container means (17) is removed from said melting chamber means (4).

9. The apparatus of claim 1, further comprising a locking member (42) movable into the path of work pieces (35) and time delay means (41) operatively connected to said locking member (42) and to said first mentioned limit switch means (9) for stopping the further feed advance of work pieces in response to the absence of meltable adhesive granular material (18) in the melting chamber means (4) as sensed by said limit switch means (9) when said first piston drive means (6) moves back into the empty melting chamber means (4).

10. The apparatus of claim 1, further comprising adhesive applicator means (2) directly connected to said adhesive discharge openings (5') of said heatable melting wall (5) of the melting chamber means.

11. An apparatus for melting and applying a meltable granular adhesive to a work piece, comprising melting chamber means (4) including a heatable adhesive melting wall (5) provided with adhesive discharge openings (5'), first power driven feed advance piston drive means (6) slidably supported in said melting chamber means (4) for discharging melted adhesive through said openings (5') in response to movement of a work piece, an adhesive inlet port (12) in a port wall of said melting chamber means (4), adhesive supply container means (17) having an outlet operatively connectable to said inlet port (12), closure slide means (13) operatively arranged for sliding relative to said port wall for simultaneously closing or opening said inlet port (12) and said outlet of said supply container means, and second separate power driven piston drive means (14) operatively connected to said closure slide means (13) for power operating said closure slide means for supplying meltable adhesive into said melting chamber means (4) and for closing off the melting chamber means (4) from the supply container means (17), and control means operatively connected to said first and second driven piston drive means (6 and 14) for operating said slide means (13) separately of and prior to operation of said first feed advance piston drive means (6) so that said closing of the opening (12) and of the outlet of the supply container (17) is completed before the feed advance piston means (6) begins to move in a feed advance direction, said apparatus further comprising pressure supply means (32, 38) operatively connected to said first feed advance piston drive means (6) for applying an increased work pressure to said first feed advance piston drive means (6) when the latter is discharging melted adhesive and for applying a lower resting pressure to said first feed advance piston drive means (6) when melted adhesive is not being discharged but present in said chamber means (4).

* * * * *